US009358811B1

(12) United States Patent
Bucci

(10) Patent No.: US 9,358,811 B1
(45) Date of Patent: Jun. 7, 2016

(54) OPTICAL PRINTING GUIDES FOR MANUALLY-ACTIVATED PRINTERS

(71) Applicant: Pyramid Technologies LLC, Meriden, CT (US)

(72) Inventor: George Bucci, Southington, CT (US)

(73) Assignee: Pyramid Technologies LLC, Meriden, CT (US)

( * ) Notice: Subject to any disclaimer, the term of this patent is extended or adjusted under 35 U.S.C. 154(b) by 0 days.

(21) Appl. No.: 14/190,245

(22) Filed: Feb. 26, 2014

Related U.S. Application Data

(60) Provisional application No. 61/769,846, filed on Feb. 27, 2013.

(51) Int. Cl.
*B41J 2/01* (2006.01)
*B41J 11/00* (2006.01)

(52) U.S. Cl.
CPC ..... *B41J 11/0045* (2013.01)

(58) Field of Classification Search
CPC ..... B41J 2/17513; B41J 2/1752; B41J 3/36; B41J 3/44; B41J 3/445; B41J 29/02; B41J 29/023; B41J 29/13; B41J 29/38
USPC ..... 347/9, 14, 101, 104, 107–109
See application file for complete search history.

(56) References Cited

U.S. PATENT DOCUMENTS

| | | | | |
|---|---|---|---|---|
| 4,506,274 | A * | 3/1985 | Coe | 346/82 |
| 4,899,173 | A * | 2/1990 | Elliano | 346/82 |
| 5,173,596 | A * | 12/1992 | Kapinos et al. | 235/475 |
| 6,558,055 | B1 * | 5/2003 | Shishido et al. | 400/248 |
| 2003/0197770 | A1 * | 10/2003 | Klinefelter et al. | 347/104 |
| 2006/0209158 | A1 * | 9/2006 | Forest et al. | 347/118 |
| 2007/0139508 | A1 * | 6/2007 | Muyskens | 347/109 |
| 2007/0147930 | A1 * | 6/2007 | Nishath | B41J 3/36 400/88 |
| 2008/0055384 | A1 * | 3/2008 | Noe et al. | 347/109 |
| 2008/0075512 | A1 * | 3/2008 | Gates et al. | 400/88 |
| 2010/0269655 | A1 | 10/2010 | Pierga et al. | |
| 2013/0201229 | A1 * | 8/2013 | Ruszala | G07C 1/06 346/80 |

* cited by examiner

*Primary Examiner* — Manish S Shah
*Assistant Examiner* — Roger W Pisha, II
(74) *Attorney, Agent, or Firm* — Maurice M. Klee

(57) ABSTRACT

A card printer is disclosed which uses shaped-illumination to illuminate the portion of a card upon which printing will occur. The shaped-illumination is produced by passing light from a light source through a light source shaping assembly. In an embodiment, the light source shaping assembly is composed of a plurality of baffles molded into the portion of the printer which defines the path of motion of the printer's print head. In this way, alignment between the shaped-illumination and the printing process is guaranteed with essentially no increase in the cost of printer and, in many cases, a reduction in cost.

7 Claims, 5 Drawing Sheets

OPTICAL PRINTING GUIDES FOR MANUALLY-ACTIVATED PRINTERS

CROSS-REFERENCE TO RELATED APPLICATION

This application claims the benefit under 35 USC §119(e) of U.S. Provisional Application No. 61/769,846 filed Feb. 27, 2013, the contents of which in its entirety is hereby incorporated by reference.

FIELD

This disclosure relates to apparatus and methods for printing information on a card, e.g., a time card. More particularly, the disclosure relates to apparatus and methods for informing the user of the location on the card where the information will be printed so that the user can properly align the card before printing commences.

DEFINITION

The word "card" is used herein in its broadest sense and includes any piece of material upon which information can be printed, irrespective of the piece's shape or composition. As non-limiting examples, a "card" can be composed of paper or plastic and can have the configuration of, for example, a standard time card, e.g., 3-4"×8-10", a printed form, e.g., an 8.5"×11" form, or a multi-part form.

BACKGROUND

Manually-activated printers are widely used to record a variety of information on cards including, most commonly, time and date information. In a typical scenario, the user inserts and aligns a card, e.g., a time card, in the printer and then activates the printer by, for example, pushing a "start" button. Alternatively, the printer can be activated by the card contacting a trip switch or the like within the printer. In this latter case, the user will align the card with respect to the location where printing is expected to occur and then push the card into its final position so that it contacts the trip switch and activates the printer.

A long-standing problem with manually-activated printers has been ensuring that the printing occurs at the location desired by the user. This is especially so in the case of time cards where multiple entries are to be made on a single card, e.g., a series of time and date entries, as routinely occurs with time cards. In the past, a plastic strip with a slot to show the print head path has been used to address this problem. The plastic strip is mounted on the printer's platen and the user positions the card under the strip so that the slot in the plastic aligns with the desired printing location.

The plastic strip approach has suffered from a number of problems. For example, the strip can be damaged as a result of inserting a card from the side as opposed to the front, thus snagging the plastic strip and tearing or deforming it. Also, because the strip is inside the unit, an auxiliary light is often required so that the user can see the slot when aligning the card.

The present disclosure overcomes these problems by eliminating the plastic strip and instead providing an optical printing guide which uses shaped-illumination to illuminate the portion of the card where the printing will take place. In this way, the user can easily and accurately align the card in the printer with full confidence that the printing will take place at the desired location.

SUMMARY

In accordance with a first aspect, a printer (5) is disclosed which includes:

(a) a platen (9) for receiving a card (13) upon which information is to be printed;

(b) a print head (1); and (c) an optical assembly for illuminating a portion (7) of a card (13) when the card (13) is received by the platen (9), said optical assembly comprising a light source (10) and a light source shaping assembly (11);

wherein:

(i) during use, the print head (1) prints information on a card (13) as the print head (1) moves along a path of motion; and (ii) the portion (7) of the card illuminated by the optical assembly is indicative of the location at which the information will be printed on the card (13) by the moving print head (1).

In accordance with a second aspect, a method of printing information on a card (13) is disclosed which includes:

(a) bringing a card (13) into contact with a platen (9) of a printer (5);

(b) adjusting the location of the card (13) relative to the platen (9) so that a shaped light beam (12) illuminates an area (7) of the card (13);

(c) activating the printer (5) so that information is printed on the card (13) in the area (7) that was illuminated by the shaped light beam (12); and (d) removing the card (13) from the platen (9).

The reference numbers used in the above summaries of the various aspects of the invention are only for the convenience of the reader and are not intended to and should not be interpreted as limiting the scope of the invention. More generally, it is to be understood that both the foregoing general description and the following detailed description are merely exemplary of the invention and are intended to provide an overview or framework for understanding the nature and character of the invention.

Additional features and advantages of the invention are set forth in the detailed description which follows, and in part will be readily apparent to those skilled in the art from that description or recognized by practicing the invention as exemplified by the description herein. The accompanying drawings are included to provide a further understanding of the invention, and are incorporated in and constitute a part of this specification. It is to be understood that the various features of the invention disclosed in this specification and in the drawings can be used in any and all combinations.

Figure 1:
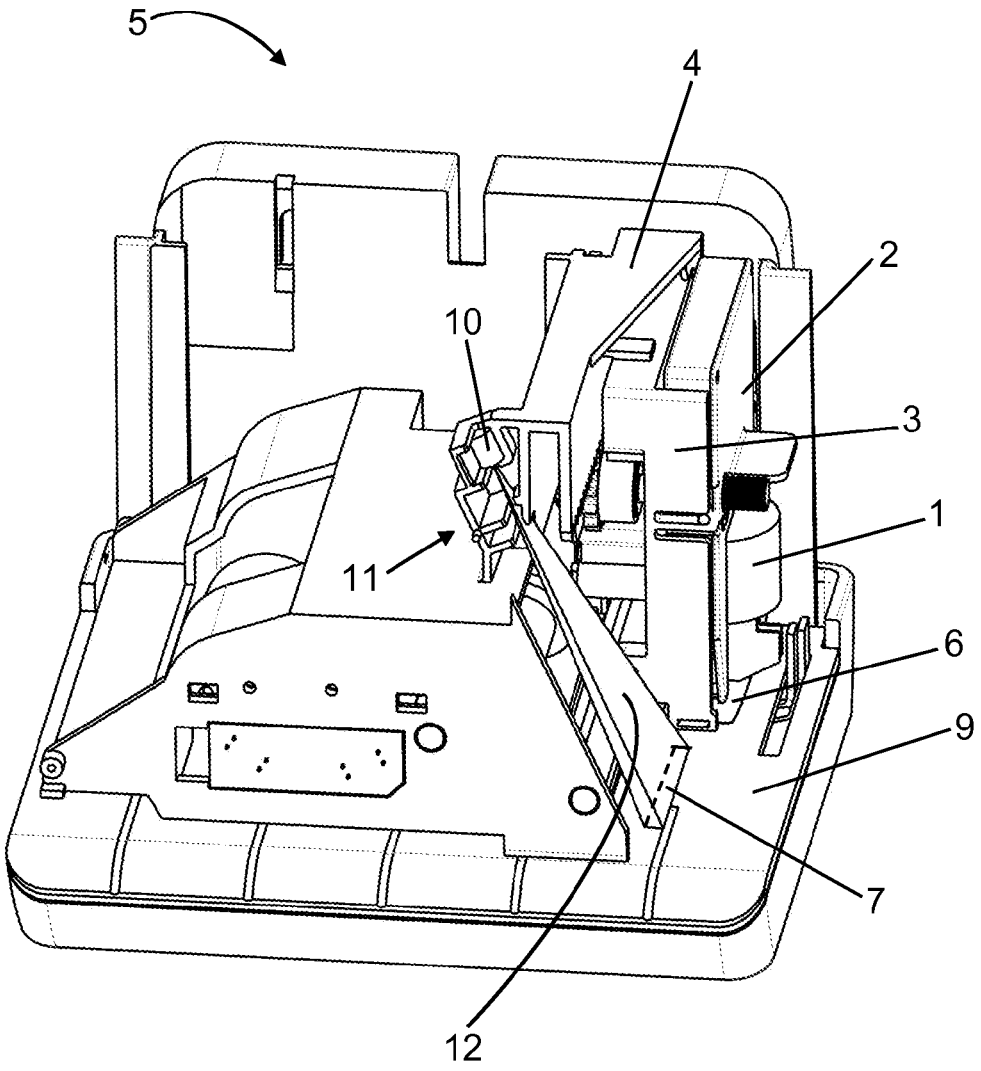
FIG. 1 is a perspective view, partially in section, of a printer constructed in accordance with an exemplary embodiment of the present disclosure. The printer's cover and some of its conventional internal parts have been removed so as not to obscure the components relevant to the present disclosure. The figure shows the printer with its print head in its print start position, prior to the placement of a card on the printer's platen.
Figure 2:
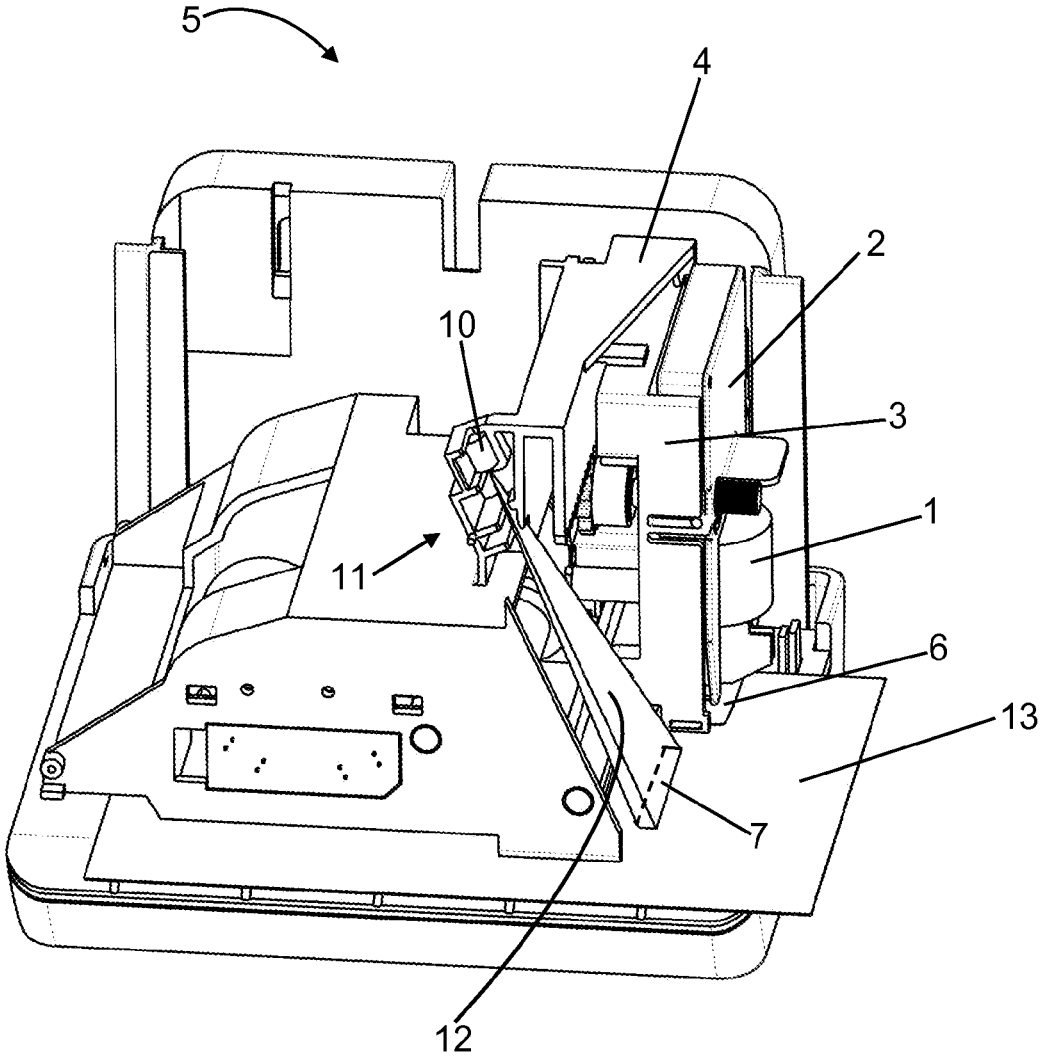
FIG. 2 is a perspective view, partially in section, of the printer of FIG. 1 with the print head in its print start position after placement of a card on the printer's platen.
Figure 3:
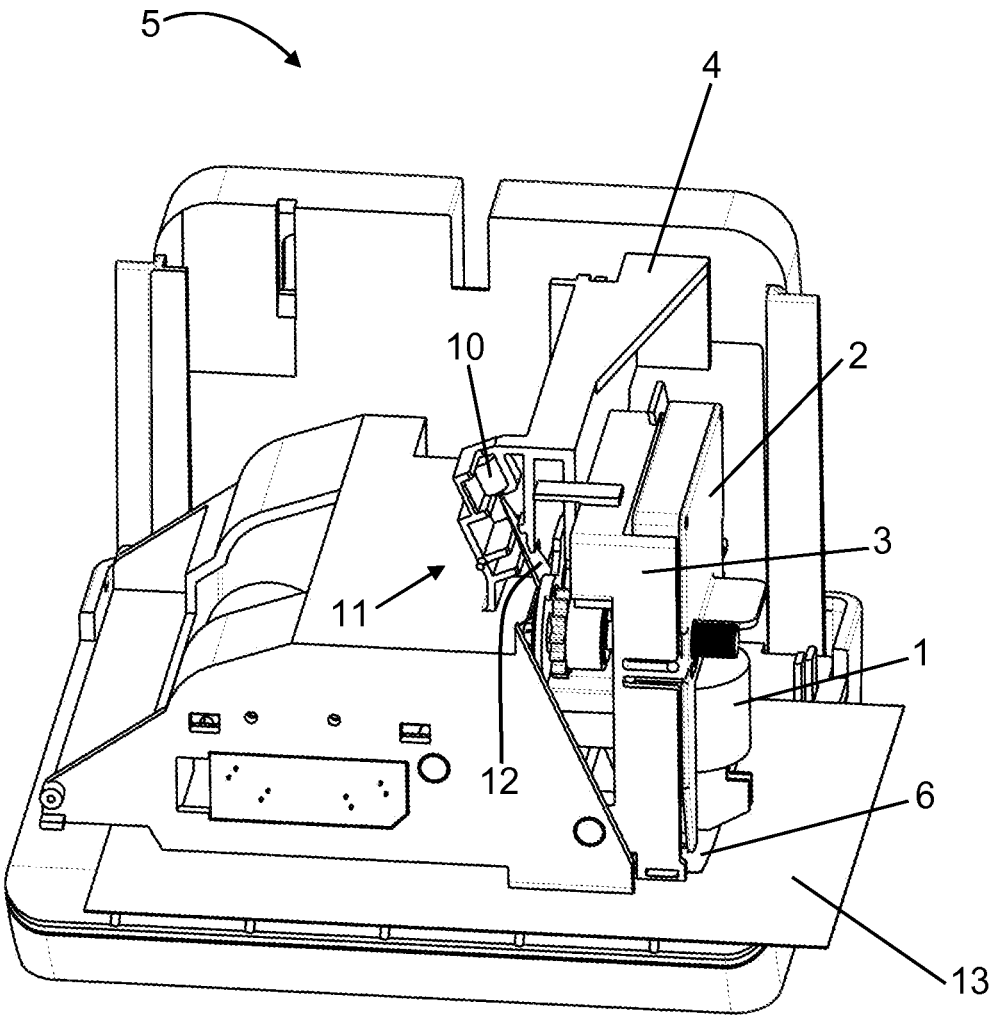
FIG. 3 is a perspective view of the printer of FIG. 2 with the card on the printer's platen and the print head in its print end position.

The reference numbers used in the figures correspond to the following:

1 print head
2 ribbon cartridge
3 carriage assembly
4 print head guide member
5 printer
6 ribbon
7 illuminated area
8 molded baffle
9 platen
10 light source
11 light source shaping assembly
12 shaped light beam (shaped-illumination)
13 card

DETAILED DESCRIPTION

As discussed above, the printer disclosed herein uses shaped-illumination to inform a user of the location on a card where information will be printed. In particular, the shaped-illumination illuminates a portion (area) of the card where the printing will occur. In most cases, all of the printing will occur in the illuminated portion of the card, although some printing can occur outside that area if desired.

FIGS. 1-5 illustrate a representative embodiment of a printer 5 constructed in accordance with the present disclosure. As shown in these figures, printer 5 includes a print head 1 with an associated ribbon cartridge 2 which are carried by a moveable carriage assembly 3. Print head 1 can include a plurality of pins (not shown) that are actuated by electrically energized solenoids (not shown). The pins strike ribbon 6 which transfers ink to a card 13 placed on platen 9.

Figure 4:
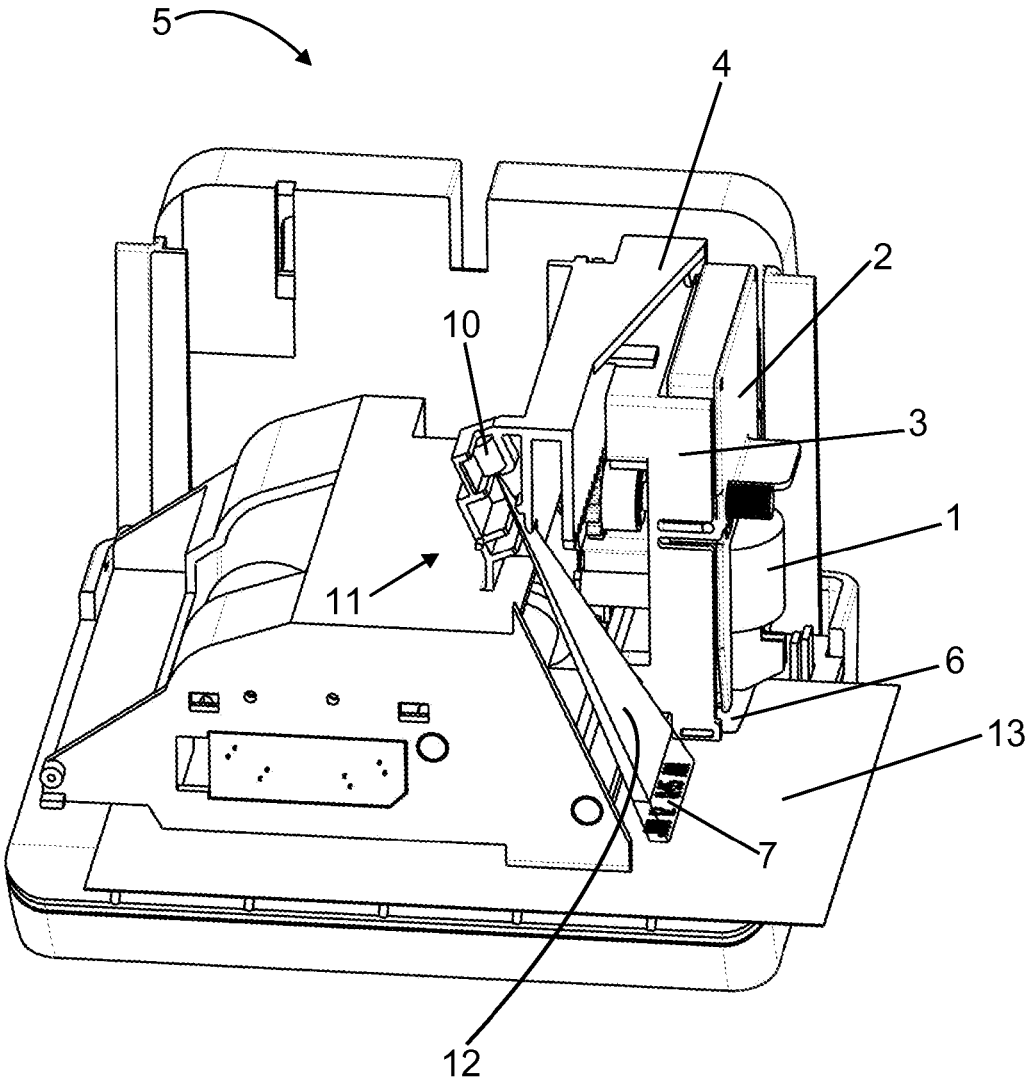
FIG. 4 is a perspective view, partially in section, of the printer of FIG. 3 with the card on the printer's platen and the print head back in its print start position. As shown, information has been printed on the card.
Figure 5:
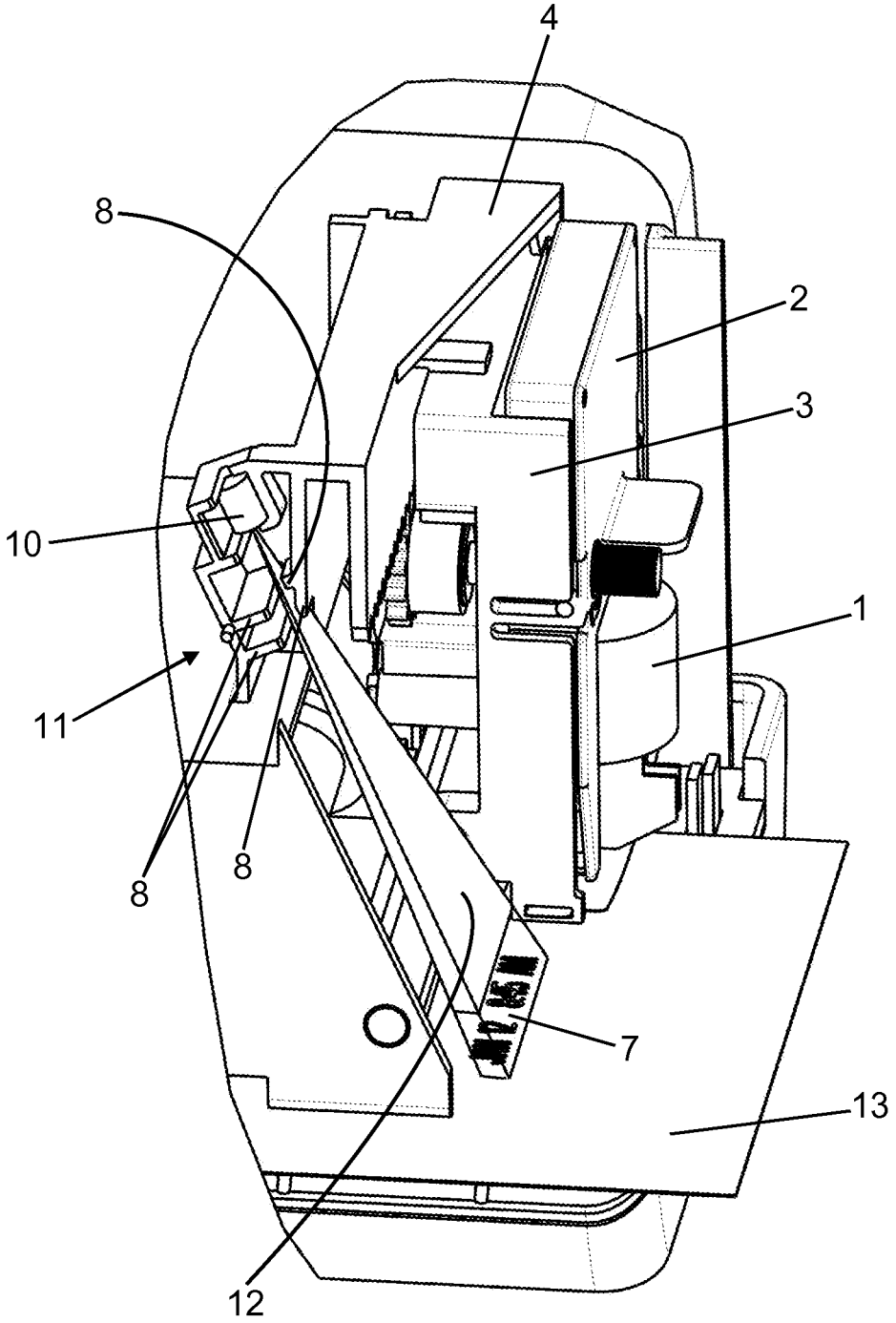
FIG. 5 is an expanded view of the printing portion of the printer of FIG. 4.

During use, carriage assembly 3 and thus print head 1 move along member 4 (the "print head guide member") from a print start position (e.g., the first position; see FIGS. 1-2) to a print end position (e.g., the second position; see FIG. 3) and then back to the print start position (e.g., the first position; see FIGS. 4-5). As the print head moves between its first and second positions, the print head prints information on the card. Normally, the printing will take place as the print head moves from the first position to the second position, but printing while the print head is returning to its first position is also possible. Such return trip printing can take place in combination with printing on the outward trip or all of the printing can be performed on the return trip.

As can be seen in the figures, a light source 10, e.g., an LED, is mounted on print head guide member 4, which, in an embodiment, is composed of molded plastic, e.g., an ABS or polycarbonate polymer. Light from the light source passes through light source shaping assembly 11 which shapes the light into shaped light beam 12, i.e., the shaped-illumination.

Prior to insertion of a card into the printer, shaped light beam 12 illuminates area 7 on platen 9 (see FIG. 1). Once a card has been placed on the platen, illuminated area 7 shows the location where the printing will occur on the card (see FIG. 2). The illuminated area 7 also provides feedback to the user as to the printing that has occurred on the card (see FIGS. 4 and 5).

As can be seen most clearly in FIG. 5, in an embodiment, light source shaping assembly 11 is the form of one or more baffles 8 molded into print head guide member 4 at the time that member is produced. Because member 4 defines the path of motion of print head 1, using this member to produce the shaped-illumination guarantees that the shaped-illumination is aligned with the printing produced by the print head. Use of two components, one to define the path of the print head and a second one to define the path of illumination, would require careful alignment between the components to ensure that the illumination would accurately inform the user where the printing was to occur. By using a single component to define the paths of both the print head and the light, the alignment problem is eliminated.

In addition, the use of a single molded component allows the shaped-illumination to be produced with essentially no additional cost since the print head guide member is going to be produced in any event. Adding a light source shaping assembly, e.g., a plurality of baffles, to the mold for the print head guide member involves little added expense. As to the light source, as noted above, light sources have previously been used in card printers which employ plastic strips for card alignment. For card printers of this type, i.e., printers that already have a light source, implementation of the technology of the present disclosure will, in fact, reduce unit cost by eliminating the plastic strip without the need to add any parts to provide the strip's function.

A variety of modifications that do not depart from the scope and spirit of the invention will be evident to persons of ordinary skill in the art from the foregoing disclosure. The following claims are intended to cover the specific embodiments set forth herein as well as modifications, variations, and equivalents of those embodiments.

What is claimed is:

1. A printer comprising:

(a) a platen for receiving a card upon which information is to be printed;

(b) a print head; and (c) an optical assembly for illuminating a portion of the card with a directed shaped light beam when the card is received by the platen, said optical assembly comprising a light source and a light source shaping assembly that produces the directed shaped light beam, said directed shaped light beam having a fixed position relative to the platen;

wherein:

(i) during use, the print head prints information on the card as the print head moves along a path of motion;

(ii) the portion of the card illuminated by the directed shaped light beam produced by the optical assembly is indicative to a user of the location at which the information will be printed on the card by the moving print head; and (iii) the directed shaped light beam is sufficiently shaped by the light source shaping assembly so that during use, the directed shaped light beam by itself is sufficient to indicate the location at which the information will be printed on the card by the moving print head without the need for a strip mounted on the platen having a slot for indicating where printing will take place.

2. The printer of claim 1 wherein:

(i) the path of motion of the print head is defined by a print head guide member; and (ii) the light source shaping assembly is part of the print head guide member.

3. The printer of claim 2 wherein the light source shaping assembly comprises at least one baffle.

4. The printer of claim 1 wherein:

(i) the path of motion of the print head is defined by a molded plastic part; and (ii) the light source shaping assembly is part of said molded part.

5. The printer of claim 4 wherein the light source shaping assembly comprises at least one baffle.

6. A method of printing information on a card comprising:

(a) bringing the card into contact with a platen of a printer;

(b) adjusting by hand the location of the card relative to the platen so that a directed shaped light beam illuminates an area of the card, said area being an area at which information will be printed on the card by the printer;

(c) activating the printer so that information is printed on the card in the area that was illuminated by the directed shaped light beam; and (d) removing the card from the platen;

wherein said directed shaped light beam has a fixed position relative to the platen and wherein the location of the card relative to the platen is adjusted in step (b) without the use of a strip mounted on the platen having a slot for indicating where printing will take place.

7. A method of printing information on a card comprising:

(a) bringing the card into contact with a platen of a printer, said printer comprising:

(i) a print head which moves along a path of motion during printing; and (ii) an optical assembly which produces a directed shaped light beam, said directed shaped light beam having a fixed position relative to the platen;

(b) adjusting by hand the location of the card relative to the platen so that the directed shaped light beam illuminates an area of the card, said area being an area at which information will be printed on the card by the printer;

(c) activating the printer so that the print head moves along its path of motion and prints information on the card in the area that was illuminated by the directed shaped light beam; and (d) removing the card from the platen;

wherein the location of the card relative to the platen is adjusted in step (b) without the use of a strip mounted on the platen having a slot for indicating where printing will take place.

* * * * *